US005339968A

United States Patent [19]

Voelz

[11] Patent Number: 5,339,968

[45] Date of Patent: Aug. 23, 1994

[54] VERTICAL MERCHANDISE DISPLAY CAROUSEL

[75] Inventor: Dale Voelz, St. Charles, Ill.

[73] Assignee: White Consolidated Industries, Inc., Cleveland, Ohio

[21] Appl. No.: 975,267

[22] Filed: Nov. 12, 1992

[51] Int. Cl.[5] ..... A47F 5/00

[52] U.S. Cl. ..... 211/121; 211/1.56

[58] Field of Search ..... 211/121, 1.56

[56] References Cited

U.S. PATENT DOCUMENTS

| | | | |
|---|---|---|---|
| 404,480 | 6/1889 | Harrington et al. | 211/121 X |
| 643,049 | 2/1900 | Feeser | 211/121 X |
| 918,937 | 4/1909 | Wilmore . | |
| 1,744,996 | 1/1930 | Ward | 211/121 |
| 2,689,638 | 9/1954 | Mojonnier . | |
| 3,874,496 | 4/1975 | Bodin . | |
| 4,534,460 | 8/1985 | Graham et al. . | |
| 4,742,924 | 5/1988 | Tarlow et al. | 211/121 X |

*Primary Examiner*—Alvin C. Chin-Shue
*Assistant Examiner*—Sarah A. Lechok
*Attorney, Agent, or Firm*—Pearne, Gordon, McCoy & Granger

[57] ABSTRACT

A vertically extending carousel for the display of clothing items and the like. The carousel provides cantilever supported, horizontally extending display racks on which the garments can be displayed. An access position at the bottom of the carousel includes a stop mat which stops the operation of the conveyor when a prospective customer approaches the access position. Manual controls are provided to allow the customer to move selected display racks to the access position, allowing the customer to inspect the garment and remove it in the event that a purchase is desired.

12 Claims, 6 Drawing Sheets

VERTICAL MERCHANDISE DISPLAY CAROUSEL

BACKGROUND OF THE INVENTION

This invention relates generally to carousel display systems, and more specifically, to vertical display carousel systems particularly suited for the display of soft goods, such as garments and the like.

Prior Art

It is known to provide carousel systems which operate to automatically move items of merchandise to an access position. Some carousels extend horizontally, and other carousels extend vertically. When the carousel extends vertically, it is possible to greatly increase the storage capacity for a given amount of floor space. Generally, in the past, such vertical carousels have been provided with bins or trays in which component parts are stored. When a particular component part is required, the carousel is operated to deliver the particular bin or tray containing the desired part to a delivery position so that it can be selectively removed. Examples of such systems are illustrated in the U.S. Pat. Nos. 918,937; 2,689,638; and 3,874,496. The U.S. Pat. No. 4,534,460 also disclosed a vertical conveyor having cantilever spools mounted on a closed loop chain to transport items from a lower receiving position to a higher delivery position.

SUMMARY OF THE INVENTION

The present invention relates to a vertical display carousel particularly suited for the display of garments. Because the carousel extends vertically, it increases the product storage capacity for a given amount of display floor space by utilizing overhead space. The carousel operates substantially continuously, and such movement tends to attract customers to the display area. The illustrated carousel provides a plurality of spaced cantilever supported display racks which extend horizontally from a supporting conveyor system. Each rack is sufficiently long to support a substantial number of clothes hangers, or the like. Therefore, a large number of garments can be supported and displayed on the carousel.

The individual display racks are mounted on a closed loop conveyor which causes the display racks to move along a vertically extending rectangular path. A power unit is connected to the conveyor and operates to progressively move successive display racks and the garments supported thereby to an access position. The power system for operating the conveyor can be programmed to stop the conveyor for a short period of time as each successive display rack reaches the access position. Alternatively, the power system can be arranged to continuously move the conveyor, and in turn, the display racks supported thereon. In either case, a stop mat is provided on the floor adjacent to the carousel which is connected to stop the movement of the carousel when a potential customer approaches the access position.

Customer-operated controls are provided to allow the customer to cause movement of the carousel conveyor in either direction so as to present the particular item of apparel the customer wishes to inspect to the access position. The customer is, therefore, given an ample opportunity to inspect any given item of apparel and to remove it for purchase if desired.

The carousel is structured for simple low cost manufacture while still retaining operational reliability and ease of maintenance. The frame is constructed from conventional commercially available structural iron which is assembled by welding. The conveyor, which supports and moves the display rack, is formed of standard hollow pin conveyor chain which passes over four sprockets that produce a rectangular conveyor path.

A laminated facing panel is bolted to the frame forward of the conveyor chain. Such panel is formed of a particle board core with a smooth, high-pressure laminate on both surfaces. Such high pressure laminate provides the opposite faces of the panel with a smooth, wear-resistant surface. One suitable wear-resistant surface may be provided by a melamine resin. Further, the front exposed face of the panel is preferably provided with a decorative finish.

The panels provide an open groove aligned with a conveyor chain. Mounted on the conveyor chain at closely spaced uniform intervals are mounting assemblies or units having an outer bearing plate adjacent to the outer face of the laminate, and an inner bearing plate adjacent to the rearward or inner face of the laminate. These bearing plates provide a bearing surface formed of ultra-high molecular weight polyethylene. The bearing plates are sized and shaped so that a substantial bearing area is provided with the surfaces of the panel so that cantilever-supported display racks are held in a uniform, horizontally extending position without causing objectionable surface wear.

Display racks or tubes are removably mounted on selected mounting units. The display racks are spaced from adjacent racks so that adequate spacing is provided for the particular garment size being displayed. If longer garments are displayed on a given display carousel, the display racks are mounted on associated mounting units selected to provide an increased spacing between adjacent display racks. This may require the use of a smaller number of display racks for a given carousel. When smaller garments are displayed, the display racks are mounted at closer intervals, and usually, a greater number of display racks can be provided. The mounting structure for the display racks is arranged for easy removal and reinstallation of the display racks. Therefore, change-overs can be simply and quickly performed when garments of different sizes are to be displayed on a given carousel.

In accordance with the present invention, a vertical display carousel has been provided which can be economically produced, which is reliable in operation, and which is user-friendly, both to the customer and the proprietor using the display rack for the sale of goods.

These and other aspects of this invention are illustrated in the accompanying drawings and are more fully described in the following specification.

DETAILED DESCRIPTION OF THE DRAWINGS

Figure 1:
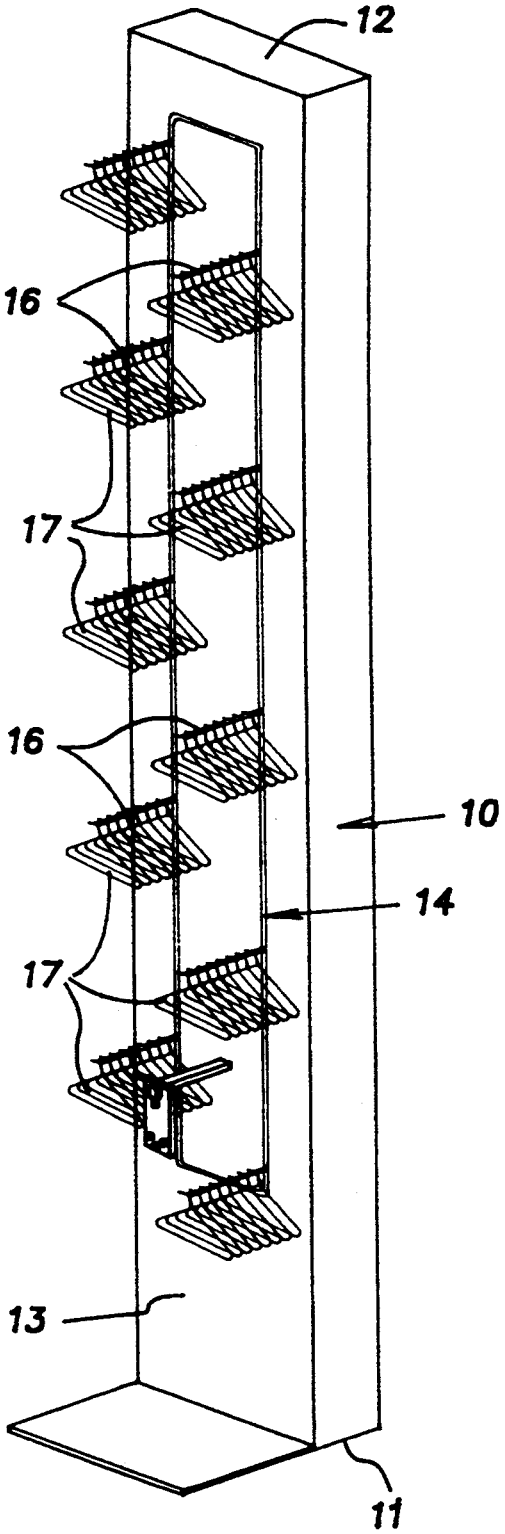
FIG. 1 is a schematic perspective view with parts removed for purposes of illustration showing a typical vertical display carousel incorporating the present invention.

FIG. 1 illustrates the general arrangement of a display carousel, in accordance with the present invention, with parts removed for purposes of illustration. The carousel includes a frame enclosure 10 which extends vertically from a lower end 11 resting on the floor to an upper end 12. The height of the carousel is typically determined by the overhead clearance in the building in which it is to be installed. Generally, the carousel is constructed to have a maximum height compatible with the building structure so that the maximum amount of merchandise can be displayed on a given carousel.

The frame enclosure is provided with front, back and side walls so as to completely enclose and protect the operating mechanism of the unit. The forward face 13 of the enclosure is provided by paneling 13 (described in greater detail below) formed with a vertically extending generally rectangular groove or opening 14 therein. Extending forwardly from the groove 14 in the paneling 13 are a plurality of cantilever-supported display racks 16.

Figure 2:
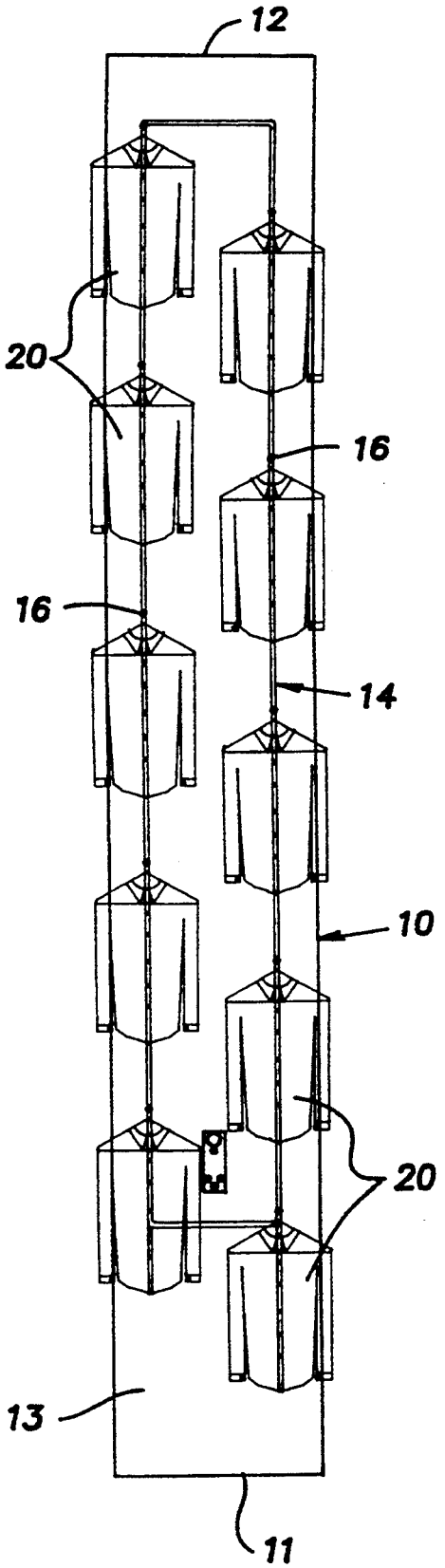
FIG. 2 is a front view similar to FIG. 1 illustrating the carousel with garments displayed on the display racks of the carousel.

In FIG. 1, clothes hangers 17 are illustrated mounted on the display racks. Typically, a plurality of hangers 17 are positioned along the length of the associated display racks 16. In use, garments 20, such as the shirts illustrated in FIG. 2, are hung on the hangers 17. If, for example, as illustrated, the display carousel is provided with ten display racks 16, and each display rack supports eight garments, a total of eighty garments can be loaded onto a given display carousel.

The spacing between the display racks 16 is adjustable (as discussed in greater detail below) and is, in each case, selected to provide adequate spacing for the length of the particular garments 20 being displayed. If, for example, shirts are displayed, as illustrated in FIG. 2, the spacing between adjacent display racks is less than when dresses having longer lengths are displayed.

The manner in which the spacing between adjacent display racks is changed is an important feature of this invention since it permits ease of customizing a given display carousel for the particular type of garment to be displayed. It should also be noted that although FIG. 2 illustrates all of the garments as being similar in type, it is within the scope of the present invention to simultaneously display various types of garments on a given display carousel. It is also within the broader scope of this invention to support trays or the like on the display racks wherein the trays support the displayed items.

Figure 3:
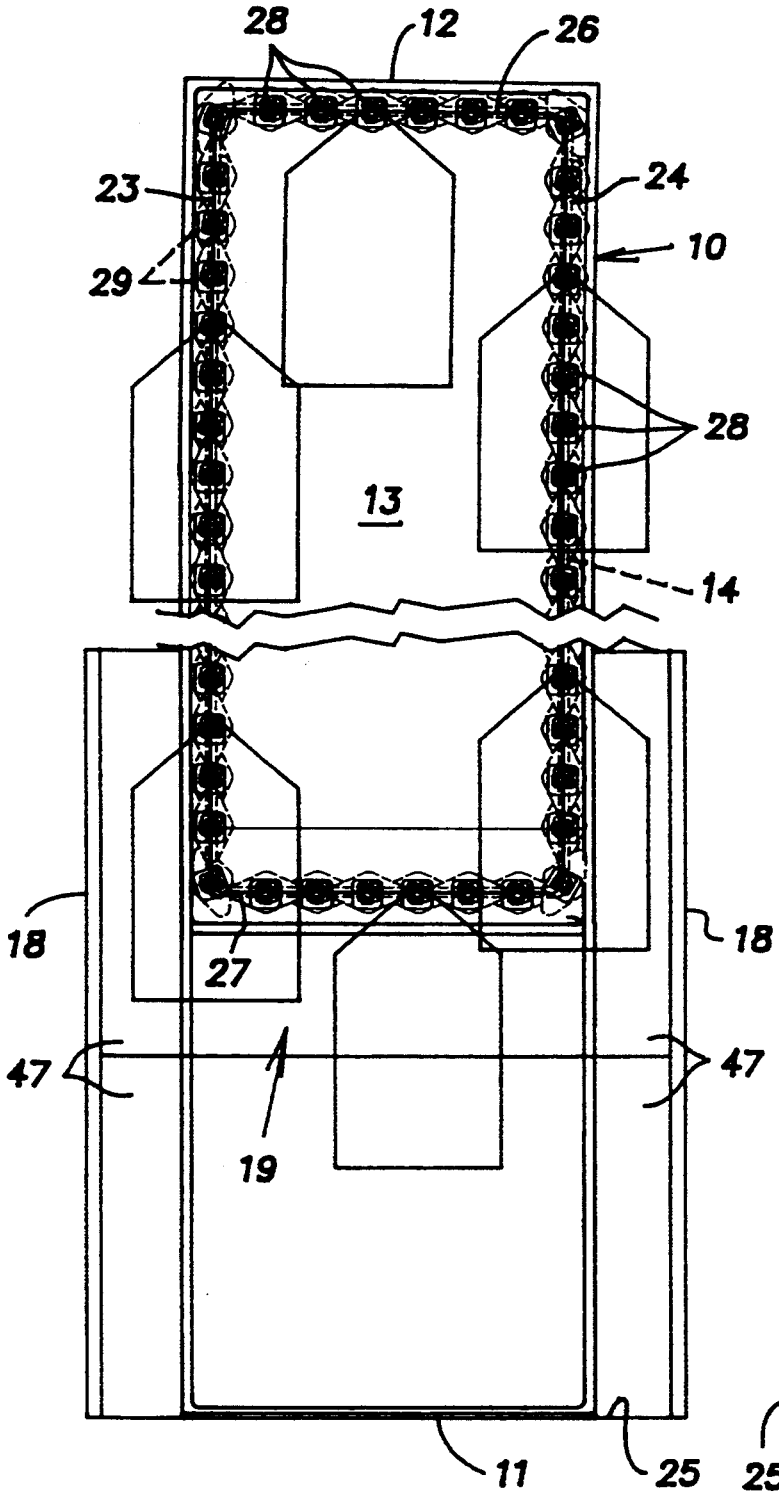
FIG. 3 is a broken front elevation of the carousel illustrating the mounting units mounted on the conveyor and the finished trim mounted at the lower end of the carousel at the access location.
Figure 4:
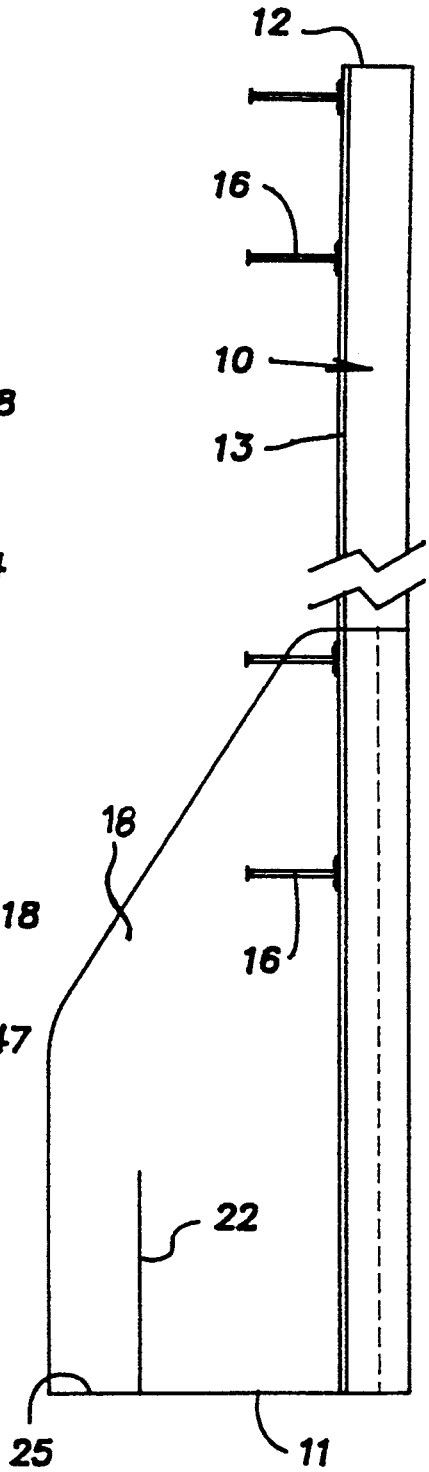
FIG. 4 is a side elevation similar to FIG. 3 partially in vertical section.

Referring now to FIGS. 3 and 4, the carousel is provided with side panels 18 adjacent to its lower end so that the customer must approach the carousel from the front to reach the access position 19. Located at the access position 19 is a stop mat 25 which extends along the floor at the access position. When a customer steps on the stop mat 25, it automatically terminates the operation of the conveyor system, and in turn, the movement of the display racks 16. Other types of sensors can be used instead of a stop mat. For example, photo eyes, motion sensors or proximity sensors may be used to stop the conveyor when a customer enters the access position. A glass or clear plastic barrier 22 is located at the access position 19. The barrier 22 is spaced forward from the extremities of the display racks 16. Such barrier 22, however, is transparent so that the customer can still see any garment, the lower end of which extends down into the zone behind the barrier 22.

The conveyor system which supports and moves the display rack is provided with two laterally spaced vertical reaches 23 and 24 along with upper and lower horizontally extending reaches 26 and 27. These reaches cooperate to provide a closed rectangular path of movement for the display racks, and in turn, the garments 18 being displayed on the carousel. For example, if it is assumed that the rotation of the conveyor is in a generally clockwise direction, the garments 18 move down along the reach 24, across the lower reach 27, up the reach 23, and across the upper reach 26 back to the reach 24. Thus, the movement of the garments is along a closed, rectangular-shaped loop.

Mounted on the conveyor system at closely spaced, uniform intervals are similar mounting unit or assemblies 28. In the illustrated embodiment, these mounting assemblies are positioned at 6-inch intervals and extend through the groove 14. They include a diamond-shaped protective cover 29 (illustrated by dotted lines) which alternately overlap the next adjacent protective cover of the next adjacent mounting assembly so that the groove 14 is completely covered, and customers cannot reach into the grooves.

Figure 5:
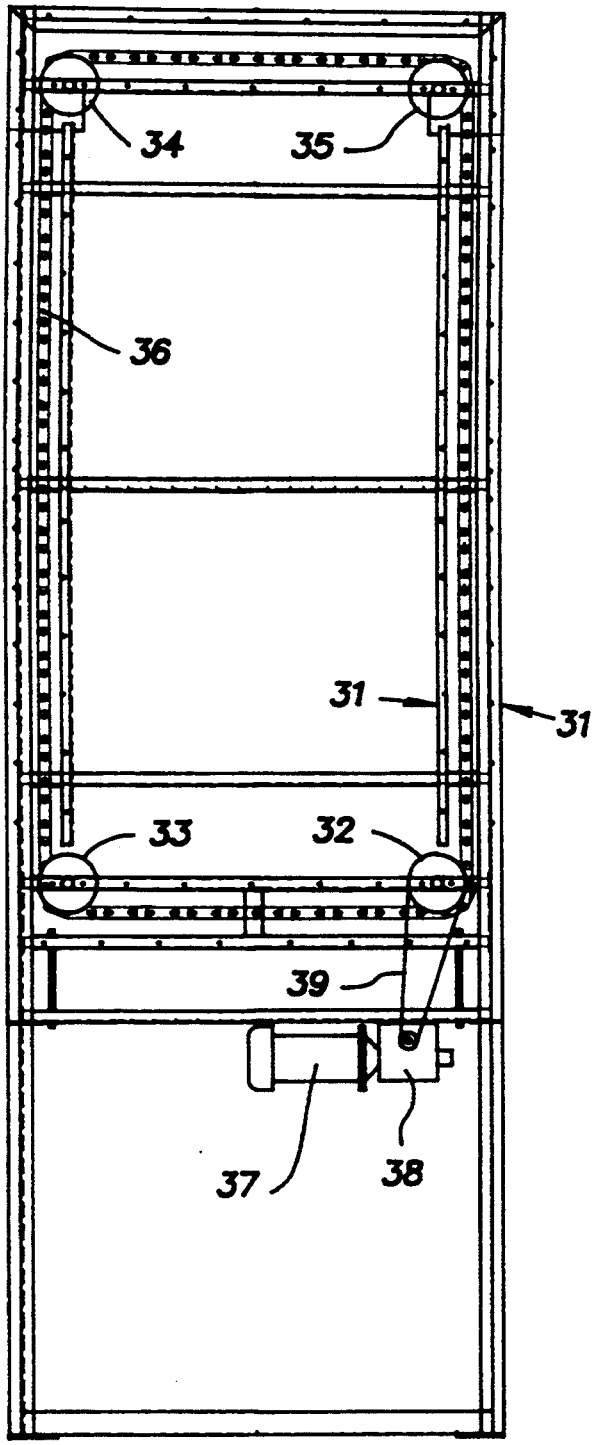
FIG. 5 is a front view of the internal frame structure and the power unit connected to drive the conveyor chain.
Figure 6:
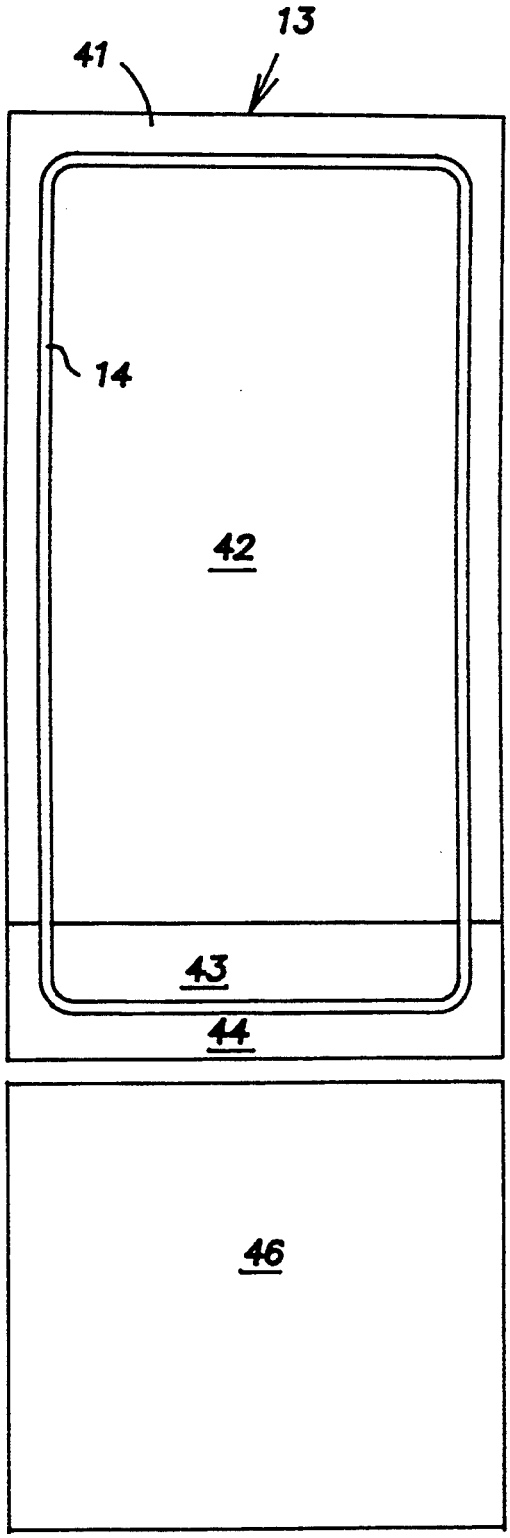
FIG. 6 illustrates the laminate panels mounted on the face of the frame.

FIG. 5 illustrates the supporting frame 31 for the carousel. It is constructed from conventional structural steel, such as angle iron and channel iron, in which the various pieces are welded together. Journaled on the frame 31 are four sprockets 32–35. The sprocket 32 is a drive sprocket, and the sprockets 33, 34 and 35 are idler sprockets. They are positioned so that a conveyor chain 36 forms a closed loop and is in alignment and immediately behind the groove 14. A drive motor 37 is connected through reduction gearing 38 and a chain 39 to power the drive sprocket 32. The paneling 13 is secured to the face of the frame immediately in front of the conveyor chain 36. As best illustrated in FIG. 6, the paneling consists of five pieces. An upper outer panel piece 41 cooperates with an upper inner panel piece 42 to provide an upper portion of the groove 14. The remaining portions of the groove 14 are defined by a lower inner panel portion 43 and a lower outer panel portion 44. A rectangular lower panel 46 encloses the lower end of the frame below the conveyor. As best illustrated in FIG. 3, side panel pieces 47 extend the panel system out to the side panels 18 at the lower end of the carousel.

Figure 7:
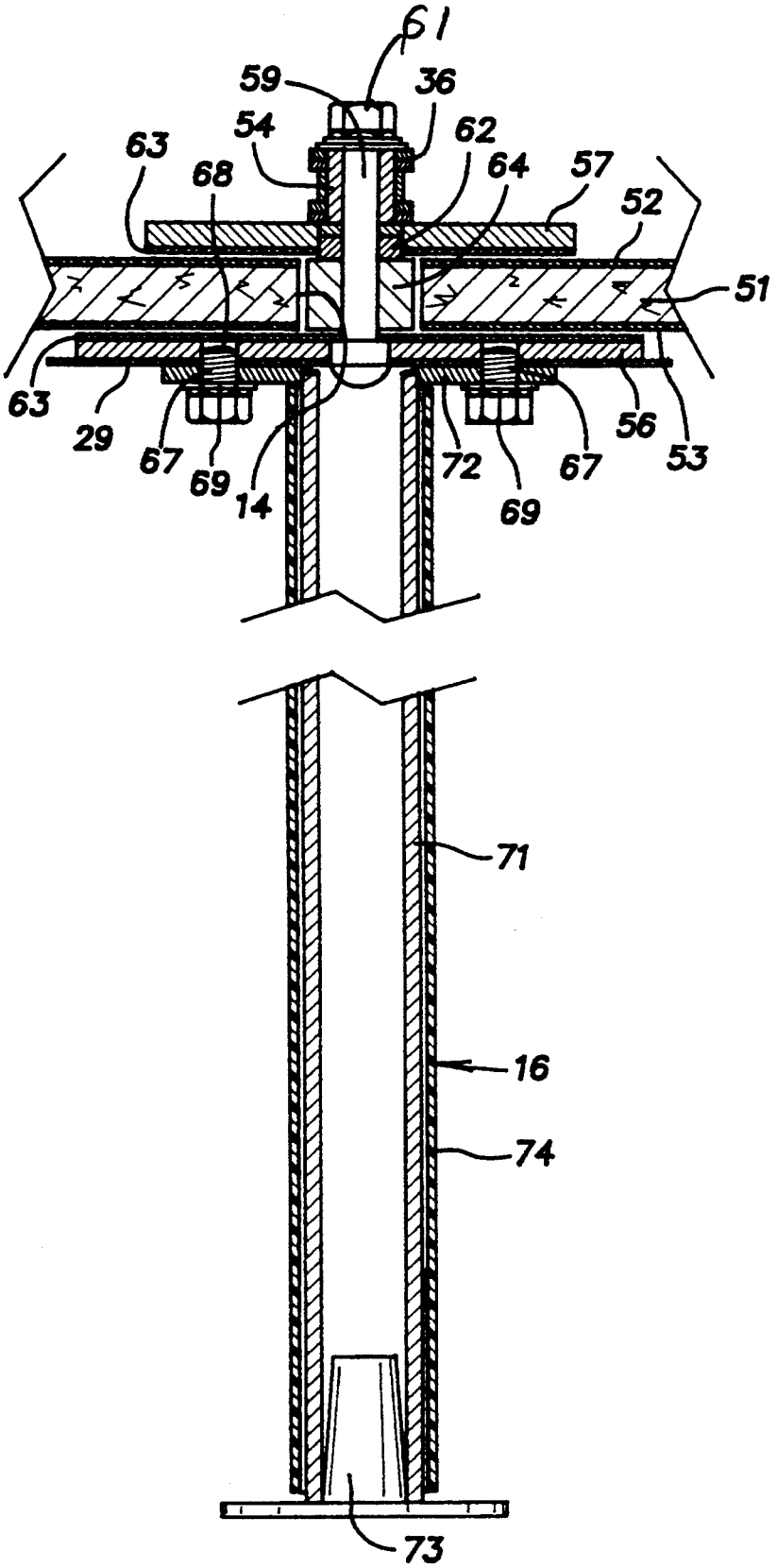
FIG. 7 is a fragmentary view illustrating the structure of a mounting unit and a display rack in longitudinal section and taken in a direction perpendicular to the conveyor chain.
Figure 8:
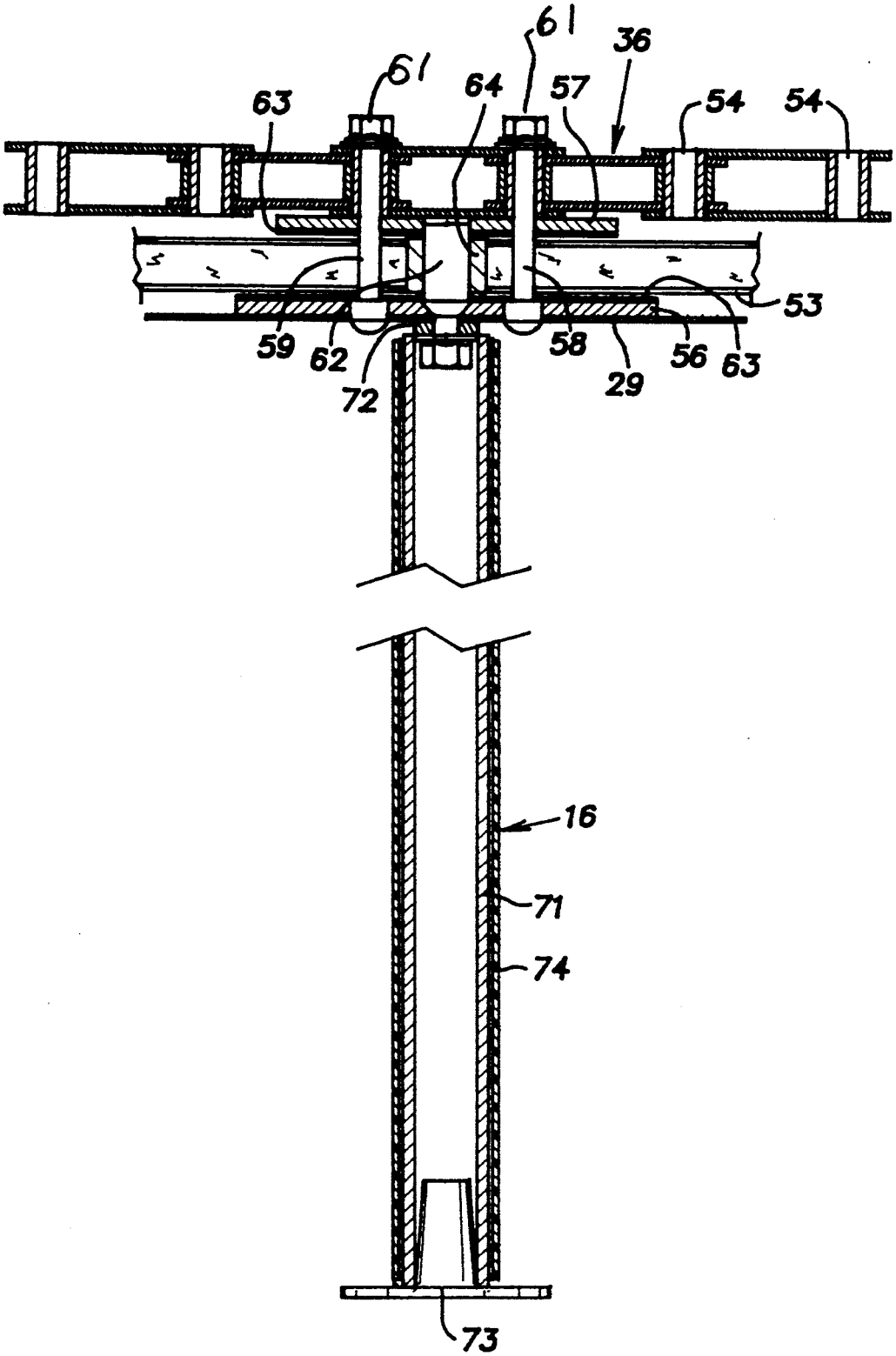
FIG. 8 is a view similar to FIG. 7 but taken at 90° with respect thereto.
Figure 9:
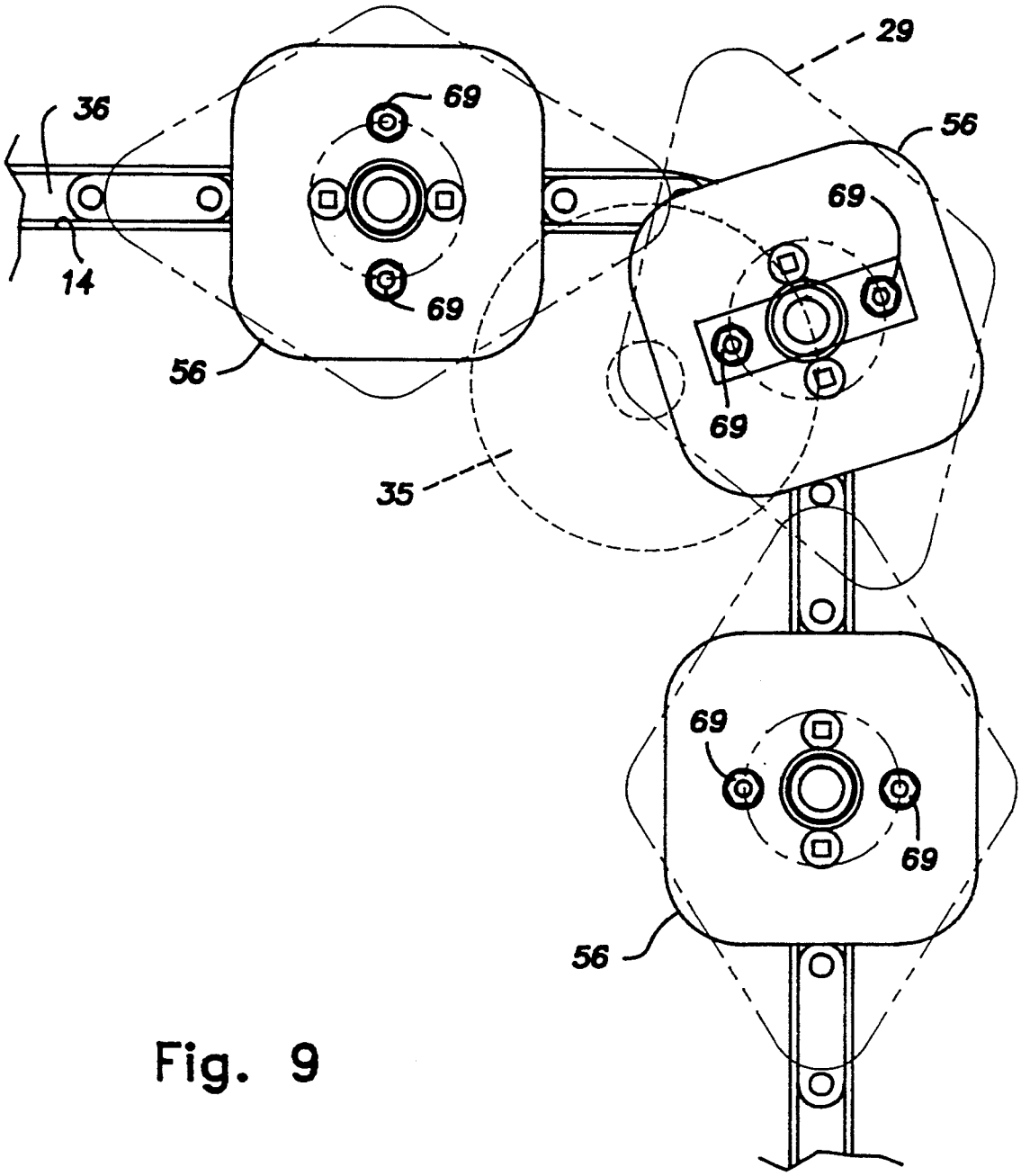
FIG. 9 is a fragmentary section illustrating the mounting units carried by the conveyor chain extending around a corner in the conveyor movement path and also illustrating the cover plates which cover the panel groove between the mounting units.

Reference should now be made to FIGS. 7-9 which illustrate, in detail, the structure of the conveyor chain, the mounting assemblies 28, and the display racks 16. The paneling 13 provides a particle board core 51 laminated along its faces with an inner or rearward high pressure laminate layer 52, and an outer or forward high pressure laminate layer 53. A melamine resin may be used for the layers 52 and 53. As previously indicated, the paneling 13 is formed of separate pieces which cooperate to define a generally rectangular groove 14.

The conveyor chain 36 is a standard conveyor chain having hollow pins 54. In the illustrated embodiment, the link length of the chain 36 is one and one-half inches. In this instance, mounting assemblies 28 are located at six-inch intervals, or at every fourth chain link. The mounting assemblies include a rectangular, forward bearing plate 56 positioned immediately adjacent to the outer high pressure laminate face or layer 53, and a similarly shaped inner bearing plate 57 positioned immediately adjacent to the high pressure laminate face or layer 52 along the rearward or inner face of the paneling 13. The two bearing plates 56 and 57 are bolted together by bolts 58 and 59 which extend through the two bearing plates and the adjacent hollow pins 54 of the chain. These bolts secure the mounting assembly elements together and also secure such elements to the adjacent link of the conveyor chain 36. Lock nuts 61 threaded onto the inner ends of the bolts 58 and 59 complete the assembly mounting.

A spacer pin 62 welded to one of the bearing plates 57 establishes the proper spacing between the two bearing plates 56 and 57. Adhesively secured to the adjacent surfaces of the two bearing plates 56 and 57 is a wear surface formed of ultra-high molecular weight polyethylene 63. This wear surface provides a low co-efficient of friction with the high pressure laminate on the paneling and serves to maintain a orientation of the mounting assemblies so that the display racks 16 mounted thereon extend in a horizontal direction perpendicular to the forward face of the paneling 13. A bearing sleeve 64 is journaled on the spacer pin 62 to guide the associated mounting assembly 28 along the groove 14 by engaging the edges of the panel along the groove 14.

In order to cover the groove between the adjacent mounting units, a diamond-shaped shield 29 is mounted on the forward face of each of the outer bearing plates 56. These shields 29 are sized so that their extremities overlap and cover the portion of the groove 14 between adjacent mounting assemblies 28. The mounting of each of the shields on its associated bearing plate is arranged so that the ends of alternate shields extend over the extremities of intermediate shields. In this manner, they do not interfere with the operation of the conveyor while providing a groove covering function.

The outer bearing plate is provided with threaded studs 67 on opposite sides of the central axis of the mounting assembly and positioned along a plane perpendicular to a plane containing the bolts 58 and 59. These studs are secured in the outer bearing plate by button welds 68 which permanently mount the studs within holes punched in the bearing plate.

Each of the display racks 16 is removably mounted on an associated one of the mounting assemblies 28 by flange nuts 69 on the studs 67. The display racks 16 are provided at intervals along the conveyor system greater than the intervals of the mounting assemblies 28 (as shown in FIGS. 3 and 4). The display racks 16 are spaced from adjacent display racks 16 so that adequate spacing is provided for the particular garment size being displayed.

When a display rack 16 is not mounted on a given mounting assembly, flange nuts 69 are placed on the studs to provide a finished appearance and to hold the associated shield in position.

Each of the display racks 16 includes a metallic tube 71 welded in one end to a lateral strap member 72 and provided with a flanged plug 73 at its outer end. Preferably, the flange plug is tapered and is mounted in the outer end of the tube 71 with an interference fit.

Positioned around the tube 71 is a non-metallic sleeve 74 which serves the dual function of providing a finished appearance for the display rack and also an effective bearing sleeve for the clothes hangers. With this structure, the friction between the clothes hangers and the sleeve 74 is sufficient to cause the tube to rotate relative to the sleeve as it moves around the rectangular path. Therefore, the hangers and the sleeve remain in a fixed physical orientation, even though they are supported by a tube which rotates through one revolution during each complete cycle of the carousel. The flange plug 73 prevents hangers from slipping off of the end of the associated display racks 16 and also provides a finished end appearance for the display rack.

The inner and outer bearing plates 56 and 57 are, preferably, formed as squares having rounded corners so that a substantial area of contact is provided between the lower edge of the outer bearing plate and the associated face of the panel and the upper edge of the inner bearing plate and the adjacent face of the panel. Therefore, high bearing loading conditions do not occur, even when a full load of garments are supported by a given display rack.

It should be recognized that the functioning bearing engagement between the bearing plates and the adjacent surfaces of the panel change as the mounting assemblies move around the rectangular path and are caused to rotate. However, it is always the lower portion of the outer bearing plate 56 which cooperates with the upper bearing surface of the inner bearing plate 57 to produce the force couple required to support the associated display rack in its horizontal, cantilever-mounted position.

In use, the number of display racks and the spacing between adjacent racks is determined by the size or length of the garment being displayed. If the carousel is to be changed from a display of relatively long dresses to short garments, such as shirts or blouses, it is merely necessary to remove the flange nuts 69 from the mounting assemblies on which display racks are to be supported, and after positioning the associated mounting strap 72 over the studs 67, the flange nuts 69 are replaced to complete the installation of a particular display rack.

Because of the easy installation of display racks, the carousel structure is user-friendly to the proprietor of the establishment utilizing the display carousel for the display and sale of his or her merchandise. Further, the carousel movement functions to attract customer interest. Also, since the customer, in effect, controls the operation of the carousel, it is an effective sales tool. When the customer steps on the stop mat 21, the conveyor operation is terminated. The customer can then cause controlled operation of the conveyor to position any selected displayed garment at the access position where it can be carefully inspected and removed if a purchase is desired.

Since the carousel is structurally simple and is fabricated with commercially available materials and parts, it can be economically produced while still providing reliable operation with little maintenance.

Although the preferred embodiment of this invention has been shown and described, it should be understood that various modifications and rearrangements of the parts may be resorted to without departing from the scope of the invention as disclosed and claimed herein.

What is claimed is:

1. A carousel comprising a powered closed loop conveyor chain, a planar guide panel mounted adjacent said chain providing a groove substantially aligned with said chain, said guide panel providing opposed bearing faces, and a plurality of cantilever mounted display rack means connected to said chain at intervals along the length thereof, said display rack means providing a pair of opposed bearing plates with one adjacent to and engaging each of said opposed bearing faces, said bearing faces and bearing plates cooperating to maintain said display rack means perpendicular to said guide panel as said display rack means are moved by said chain about said closed loop.

2. A carousel as set forth in claim 1, wherein said guide panel extends vertically, said display rack means including mounting units mounted on said chain at first intervals, said display rack means also including horizontally extending cantilever support rods at second intervals greater than said first intervals and each removably mounted on an associated one of said mounting units, said mounting units providing said bearing plates.

3. A carousel as set forth in claim 2, wherein said mounting units include shields on a side of said guide panel remote from said chain to cover said groove between said mounting units.

4. A carousel as set forth in claim 2, wherein said bearing plates are provided by an ultra-high molecular weight polyethylene bearing surface.

5. A carousel as set forth in claim 4, wherein said guide panel is a laminate provided with melamine resin wear surfaces.

6. A carousel as set forth in claim 1, wherein said carousel provides an access position, and stop means are provided to stop said conveyor chain when a user enters said access position.

7. A carousel as set forth in claim 6, wherein manually operated controls are provided at said access position to permit said user to operate said conveyor chain to move a selected display rack to said access position.

8. A carousel as set forth in claim 7, wherein a barrier is positioned between said step means and the adjacent ends of said display rack.

9. A display carousel for displaying items of merchandise comprising closed looped conveyor means, power means connected to drive said conveyor means, said conveyor means providing a number of mounting units at substantially uniform intervals along the length of said conveyor means, a number of display racks each removably mounted on an associated one of said mounting units, said number of display racks being substantially less than said number of mounting units, said associated mounting units being spaced from adjacent associated mounting units by at least one of said mounting units, each of said display racks being removably mountable on any one of said mounting units whereby the number of display racks and the spacing therebetween can be changed to allow a display of items of merchandise of different sizes.

10. A display carousel as set forth in claim 9, wherein said display racks include a cantilever supported ridged rod and a non-metallic sleeve positioned around said rod, said sleeve and rod being rotatable relative to each other.

11. A display carousel as set forth in claim 10, wherein garment hangers are removably supported on said sleeve and operate to resist rotation of said sleeve with said rod.

12. A vertical display carousel for displaying garments comprising a frame, a powered hollow pin conveyor chain supported on said frame for progressive movement around a closed loop, panels mounted on said frame adjacent to said chain providing an open groove aligned with said chain, mounting units mounted on said chain at uniform first intervals, said panels providing a wear-resistant coating on the inner and outer faces thereof, said mounting units providing a generally square bearing plate adjacent to each of the faces of said paneling, said bearing plates providing a bearing material engagable with the opposite faces of said panel operable to maintain said mounting units in a fixed orientation with respect to said panel, and removable cantilever display racks mounted on selected mounting units at spaced locations, said display racks providing a cantilever supported rod for supporting garments as the display racks are moved by said chain around said closed loop, said carousel providing an access position, and stop means operable to stop said carousel when a user enters said access position.

* * * * *

UNITED STATES PATENT AND TRADEMARK OFFICE

CERTIFICATE OF CORRECTION

PATENT NO. : 5,339,968

DATED : August 23, 1994

INVENTOR(S) : Dale Voelz

It is certified that error appears in the above-identified patent and that said Letters Patent is hereby corrected as shown below:

Column 8, line 2, (Claim 8, line 2), delete "step" and insert --stop--.

Signed and Sealed this

Tenth Day of January, 1995

*Attest:*

Bruce Lehman

BRUCE LEHMAN

*Attesting Officer*

*Commissioner of Patents and Trademarks*